US009419366B2

(12) United States Patent
Barrefelt et al.

(10) Patent No.: US 9,419,366 B2
(45) Date of Patent: Aug. 16, 2016

(54) CONTACT ASSEMBLY FOR A COMBINED POWER AND DATA CONNECTOR AND SOCKET ASSEMBLY FOR A MATING CONNECTOR SOCKET

(71) Applicants: Tyco Electronics Svenska Holdings AB, Jaerfaella (SE); TE Connectivity Nederland BV, 's-Hertogenbosch (NL)

(72) Inventors: Rickard Barrefelt, Stockholm (SE); Dolf Campschroer, Wijchen (NL); Sebastiaan Roger Neerincx, Tilburg (NL)

(73) Assignees: Tyco Electronics Svenska Holdings AB, Jafalla (SE); TE Connectivity Nederland BV, 'S-Hertogenbosch (NL)

( * ) Notice: Subject to any disclaimer, the term of this patent is extended or adjusted under 35 U.S.C. 154(b) by 0 days.

(21) Appl. No.: 14/320,204

(22) Filed: Jun. 30, 2014

(65) Prior Publication Data

US 2015/0004845 A1 Jan. 1, 2015

(30) Foreign Application Priority Data

Jul. 1, 2013 (EP) ..... 13174536

(51) Int. Cl.

| | |
|---|---|
| ***H01R 13/46*** | (2006.01) |
| ***H01R 13/04*** | (2006.01) |
| ***H01R 13/504*** | (2006.01) |
| ***H01R 13/518*** | (2006.01) |
| ***H01R 13/66*** | (2006.01) |
| ***H01R 24/62*** | (2011.01) |
| *H01R 12/70* | (2011.01) |

(Continued)

(52) U.S. Cl.

CPC ..... *H01R 13/46* (2013.01); *H01R 13/04* (2013.01); *H01R 13/504* (2013.01); *H01R 13/518* (2013.01); *H01R 13/6658* (2013.01); *H01R 24/62* (2013.01); *H01R 12/707* (2013.01); *H01R 12/7088* (2013.01); *H01R 12/724* (2013.01); *H01R 13/506* (2013.01); *H01R 2201/04* (2013.01)

(58) Field of Classification Search

CPC ..... H01R 23/02; H01R 24/60; H01R 24/62
USPC ..... 439/660, 108, 101, 947
See application file for complete search history.

(56) References Cited

U.S. PATENT DOCUMENTS 5,575,690 A * 11/1996 Eaton ..... H01R 13/187 439/176
6,592,409 B1 * 7/2003 Oehme ..... H01R 13/52 439/680

(Continued)

*Primary Examiner* — Phuong Dinh
(74) *Attorney, Agent, or Firm* — Faegre Baker Daniels LLP

(57) ABSTRACT

The invention relates to a contact assembly for a combined power and data connector and to a socket assembly for a mating socket. In order to provide a combined power and data connector that allows combined transport of electrical power and data signals, which is compact, solid and may be produced cost-effectively, it is intended according to the invention that a connector face of the contact assembly comprises a data section and a second section, wherein the data section comprises a plurality of data contacts, which are separated from the second section by at least one separating wall assembly, the data contacts being arranged on a carrier unit that is mounted on a data section side of the separating wall assembly, that the carrier unit further carries electric power and wherein the at least one separating wall assembly comprises a fixation sub-assembly that fixates the carrier unit onto the separating wall assembly.

18 Claims, 8 Drawing Sheets

(51) Int. Cl.
*H01R 12/72* (2011.01)
*H01R 13/506* (2006.01)

(56) References Cited

U.S. PATENT DOCUMENTS 7,402,078 B2 * 7/2008 Wan ..... H01R 13/65802 439/607.01
8,079,978 B2 * 12/2011 Hirszowicz ..... A61M 25/1002 604/103.07
8,303,337 B2 * 11/2012 Ballard ..... B60R 16/0207 174/113 R
8,715,016 B2 * 5/2014 DeBock ..... H01R 13/514 439/701
9,022,813 B2 * 5/2015 Wilkner ..... H01R 13/4361 439/701
2005/0048846 A1 * 3/2005 Suzuki ..... H01R 24/60 439/660

* cited by examiner

CONTACT ASSEMBLY FOR A COMBINED POWER AND DATA CONNECTOR AND SOCKET ASSEMBLY FOR A MATING CONNECTOR SOCKET

This application claims priority from European Patent Application EP13174536.6 filed Jul. 1, 2013, the subject matter of which is incorporated herein by reference.

BACKGROUND

The invention relates to a contact assembly for a combined power and data connector. The invention further relates to a socket assembly for a mating connector socket.

In order to save material and installation costs of connections between electronic devices which need to be connected with electric power cables and data cables, the provision of combined power and data connectors is desired. In the prior art, the Power over Ethernet (PoE) standard is known and widely used. In this standard, data lines of standard network cables are used to transmit electric power for connected devices additionally to the data signals. Due to the low wire cross-section of the wires which are used in standard Ethernet cables and the low cross-sections of the used contact pins in standard Ethernet connectors, only a limited amount of electric power can be transmitted through the cables to a device.

SUMMARY

It is an object of the present invention to overcome the limitations of known combined signal and power connectors and to provide a combined connector that is capable of transmitting both electrical power and data signals in a single and compact connector assembly.

This object is achieved according to the invention for a combined power and data connector as mentioned in the beginning in that a contact assembly for a combined power and data connector comprises a connector face, facing in a connecting direction, the connector face comprising a first section and a second section, wherein the first section is a data section and comprises a plurality of data contacts, which are separated from the second section by at least one separating wall assembly, the data contacts being arranged on a carrier unit that is mounted on a data section side of the separating wall assembly, the data section side of the separating wall assembly being opposite the second section of the connector face, wherein the carrier unit further carries electric power, and wherein the at least one separating wall assembly comprises a fixation sub-assembly that fixates the carrier unit onto the separating wall assembly.

The contact assembly according to the invention thus provides a combined connector for power and data transmission. The carrier unit is adapted to carry both, data signals and electric current. The data contacts may be adapted to each carry electric currents up to 1 Ampere, preferably up to 0.5 Ampere. Using an additional carrier unit for the data contacts, which is mounted on the data section side of the separating wall assembly, plus the arrangement of the data contacts facing away from the second section provides a highly compact and solid connector face.

The second section may be adapted as a power section which comprises additional power contacts which are separated from the data contacts. These additional power contacts may be adapted for transmitting electric power that exceeds the allowable power on PoE-cables and on the data contacts. The additional power contacts may preferably have a higher cross-section than the data contacts.

The second section may also be used for the implementation of additional connector elements such as additional data contacts, optical fibre connectors, and/or dummy contacts.

For the socket assembly as mentioned in the beginning, the object of the present invention is achieved in that the socket assembly for a combined power and data socket comprises a socket housing, a data section and a second section, wherein the second section comprises at least two contact elements and wherein the data section comprises a plurality of data contacts, the contact elements and the data contacts being situated in a shared open volume.

The socket assembly according to the invention thus provides a data socket, which is compact and which is producible with a low material usage.

In the following, further improvements are described. The additional improvements may be combined independently of each other, depending on whether a particular advantage of a particular improvement is needed in a specific application.

According to a first advantageous improvement, both the carrier unit of the connector and the data section of the socket can each comprise eight data contacts in order to be compatible with standard network connection techniques, especially with Gigabit Ethernet or Power over Ethernet connections and with the standard type of Ethernet cables which carry eight wires.

The data contacts may be arranged on a data contact face of the carrier unit. The data contact face may be opposite the second section of the connector face.

In order to achieve a secure fixation of the carrier unit on the separating wall assembly along a data contact plane and to positively lock the carrier unit perpendicular to the connecting direction, the fixation sub-assembly may comprise at least one fixation wall that fixates the carrier unit.

The connector face may comprise an open volume above the data contacts on the data section side of the carrier unit, the open volume receding from the connector face against the connecting direction. The open volume may allow an access to the data contacts on the carrier unit, providing an easy connectivity to a mating socket and also allowing a visual inspection of the contacts on the carrier board.

According to another advantageous improvement, a protective wall member may define the open volume opposite the carrier unit. A protective wall member may protect the contacts on the carrier unit against mechanical damage. It may also be used to improve the stability of a connection to a mating socket when the socket comprises a receptacle for the protective wall member.

To provide a reliable mounting of the carrier unit on the at least one separating wall assembly, said fixation sub-assembly may positively lock the carrier unit onto the separating wall assembly.

In order to provide a separating wall assembly, onto which a carrier board can be mounted subsequently and which provides a secure mounting of the carrier board in a direction facing away from the data section side, the fixation sub-assembly may comprise at least one groove which opens into the connector face and which extends parallel to the connecting direction, the carrier unit comprising at least one locking sub-assembly, which is configured to be inserted into the at least one groove against the connecting direction.

To provide a reliable seat and a simple construction of the fixation sub-assembly, the fixation sub-assembly may comprise two grooves which extend on two opposite sides of the at least one separating wall assembly, the two grooves facing each other.

The locking sub-assembly of the carrier unit may be provided with at least one locking protrusion, which protrudes from a bottom surface of the carrier unit, the bottom surface facing the second section, the locking protrusion being configured to be engaged to a locking feature on the separating wall assembly. The locking feature may be adapted to lock the carrier board against movement in the connecting direction. To align the carrier unit on the data section side of the separating wall assembly, the locking feature may be at least in parts arranged perpendicular to the connecting direction.

In order to lock a mounted carrier board against being moved in a direction away from the data section side, the locking protrusion may extend perpendicular to the connecting direction into the at least one groove.

To provide a simple construction, the locking protrusion may be a separate strip fixed onto the carrier unit. The separate strip may have a rectangular shape, with the two short sides of the rectangle being inserted into two grooves of the fixation sub-assembly, the grooves facing each other.

A simple construction and reliable fixation of the locking protrusion on the carrier unit can be achieved when the locking protrusion is soldered onto the carrier unit. The bottom surface of the carrier unit may comprise soldering pads, which may be tin-plated. The soldering pads may be used for soldering the carrier unit onto the locking protrusion.

To provide a solid connector and electric insulation between the data carrier and additional elements in the second section, such as additional power contacts, the connector face may comprise at least one protruding shaft, which is adapted to receive at least one additional connector element, one wall of the shaft being part of the separating wall assembly. The shaft may be opened in the connecting direction for the additional connector element being connected with a mating socket. A separating wall assembly that is formed by walls of at least one shaft leads to a simple construction and a saving of material during the production. The carrier unit may be directly seated on the wall of the shaft that is part of the separating wall assembly.

A simple construction and easy access to ends of data cables that are connected to the data contacts may be provided when the connector face is mounted in a mounting member with a mounting side facing in the connecting direction. The mounting member may be adapted to be locked with a complementary receiving structure, the receiving structure being fixated relatively to a combined power and data socket, which is adapted to be matable with the combined power and data connector.

In order to allow for compensation of tolerances between the connector and the mating socket during mating and during locking of the mounting member with the complementary receiving structure, the connector face may protrude through a face opening in a mounting side of the mounting member, the face opening being laterally greater than the connector face and comprising a floating space which laterally surrounds the connector face.

The carrier unit may be fixated onto the separating wall assembly. The mounting member may be adapted to allow a relative movement between the separating wall assembly together with the fixated carrier unit and the mounting member at least perpendicular to the connecting direction inside the floating space.

In order to allow the combined power and data connector to carry electrical power additionally to the electric power which is carried via the carrier unit, the second section may be a power section which comprises at least one, preferably two power contacts.

An advantageous embodiment of the contact assembly may have a smaller connector face area than a standard 8P8C-RJ45-connector. Said 8P8C-RJ45-connector with a connector face width of 11.7 mm has a connector face area of 170 $mm^2$. The combined power and data connector according to the invention may have a connector face area less than 150 $mm^2$ at a connector face height of 12 mm or less, more preferably 10 mm or less.

The carrier unit may be formed by a printed circuit board, the printed circuit board carrying data contacts which are formed as data contact strips. The data contact strips may be adapted to carry both, data signals and electric power. The use of a printed circuit board can effectively reduce the manufacturing costs. Data contact strips, which may be adapted for being electrically contacted to mating contacts of a socket, provide a reliable and simple contact design. The data contact strips may be arranged on the data contact side of the carrier unit which is formed by the printed circuit board.

The data contact surfaces may comprise soldering sites for soldering data cables onto the data contacts.

The integrity of data signals carried by the data contacts may be improved when the data contacts are arranged in parallel pairs, the distance of a pair of data contacts being smaller than the distance between two adjacent data contacts of different pairs.

A plurality of twisted cable pairs may be connected to the carrier unit, each twisted cable pair being electrically connected to a pair of adjacent data contacts. The pair-wise connection between cable pairs and pairs of data contacts may improve the integrity of data signals carried by the data cables close to the carrier unit in comparison with the cable arrangements as defined by the T568A standard.

The data contact strips may comprise a soldering end and a connecting end, the connecting end facing in the connecting direction. A distance between centre lines of two data contact strips of at least one pair of data contact strips may be between 1.4 and 1.6 times the width of a data contact strip at its connecting end.

A distance between centre lines of two adjacent two contact strips of different pairs may be between 2.1 and 2.3 times the width of a data contact stripe at its connecting end. The arrangement of data contact strips with the distances mentioned before may improve the integrity of data signals being carried by the data contact strips.

The contact assembly may comprise an enclosing structure, the enclosing structure surrounding the mounting member at least in parts and being configured to lock the mounting member to the complementary receiving structure of a socket, providing a stable connection between the connector and a mating socket and protecting a connected connector against being accidentally removed.

The enclosing structure may comprise an electromagnetic shielding member, providing electromagnetic shielding for the connector.

According to another advantageous improvement, additional power contacts may be formed by female contacts for mating blade contacts on a mating socket. Each female contact may be located inside a shaft, the shaft being opened towards the connecting direction.

According to a first advantageous improvement of a socket assembly according to the invention, the data contacts of the socket assembly may be formed by spring contacts, each spring contact having a mounting section and a spring section. Each spring section of a spring contact may be adapted to contact one data contact of a mating connector. Each spring section may comprise a spring face, facing towards data contacts of an inserted connector. The spring faces may be arranged in the shared open volume of the socket assembly, facing the contact elements.

A stable connection between a socket and a mating connector can be achieved when the at least two contact elements are formed by blade contacts, a common plane of the blade contacts being aligned in parallel to an array of data contacts.

The contact elements can be power contacts to carry electric power additionally to the electric power carried by the data contacts of the carrier board.

To allow the power contacts to carry electric power which exceeds the limitation of the data contacts, each blade contact may have a width which is measured parallel to the common plane and perpendicular to the connecting direction, which is a multiple of a width of a data contact.

The contact elements may also be additional data contacts, optical fibre connectors and/or dummy contacts, depending on the elements which are used in the second section of a mating contact assembly.

Dummy contacts can be used to protrude into empty shafts of a mating contact assembly to further increase the stability of the connection between connector and socket.

A safe handling of the socket may be achieved when the socket housing comprises at least one separating structure between two contact elements, the separating structure extending perpendicular to a plane of the contact elements.

According to another advantageous improvement, the socket housing may comprise at least two pockets and the plurality of contacts may comprise U-shaped fixation members, the fixation members being inserted into the pockets. Thus, a compact socket may be achieved.

In the following, the invention and its improvements are described in greater details using exemplary embodiments and with reference to the figures. As described above, the various features shown in the embodiments may be used independently of each other in specific applications.

In the following figures, elements having the same function and/or the same structure will be referenced by the same reference signs.

DETAILED DESCRIPTION

Figure 1:
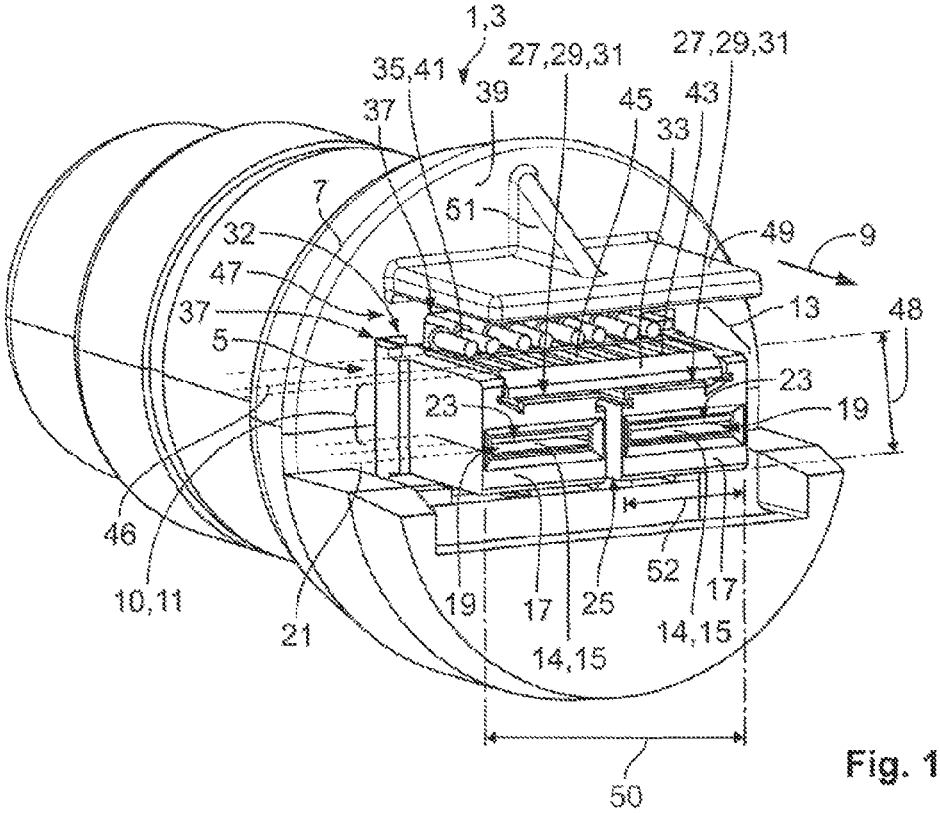
FIG. 1 shows a schematic perspective view of a first embodiment of a contact assembly according to the invention.

FIG. 1 shows an embodiment of a contact assembly 1 according to the invention assembled to a combined data and power connector 3.

The contact assembly comprises a connector face 5. The connector face 5 may be embedded in a mounting member 7. The connector face 5 is facing in a connecting direction 9. The connector face 5 comprises a data section 13 and a second section 10. In this embodiment, the second section 10 is a power section 11. The power section 11 comprises two additional elements 14 which are power contacts 15, the power contacts 15 may be formed as female contacts which are opened in the connecting direction 9.

The power contacts 15 are situated inside rectangular shafts 17. The shafts 17 have rectangular openings 19, the rectangular openings 19 being arranged parallel to a power contact plane 21, which is defined by insertion openings 23 of the power contacts 15. The power contacts 15 are adapted to receive flat blade contacts 129 of a mating socket assembly 119.

The shafts 17 are arranged adjacent to each other and parallel to the power contact plane 21, the shafts 17 being separated by a separating space 25. Each shaft 17 has a wall 27 which faces the data section 13. The walls 27 form a separating wall assembly 29 of the connector face 5. The separating wall assembly 29 has a data section side 31, facing away from the power section 11.

The connector face 5 protrudes through a face opening 37 in a mounting side 39 of the mounting member 7. The face opening 37 is laterally greater than the connector face and leaves a floating space 32 between the connector face 5 and the mounting side 39. The floating space 32 allows the movement of the connector face 5 in two perpendicular directions to the connecting direction 9.

Figure 4:
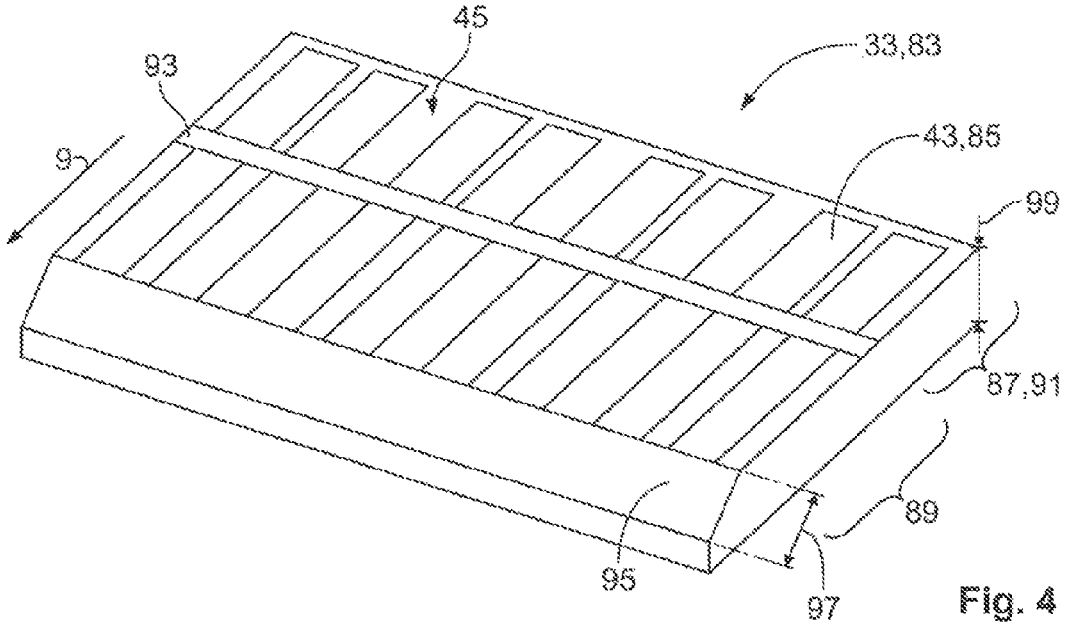
FIG. 4 shows a schematic perspective top view of a carrier unit according to the first embodiment.
Figure 5:
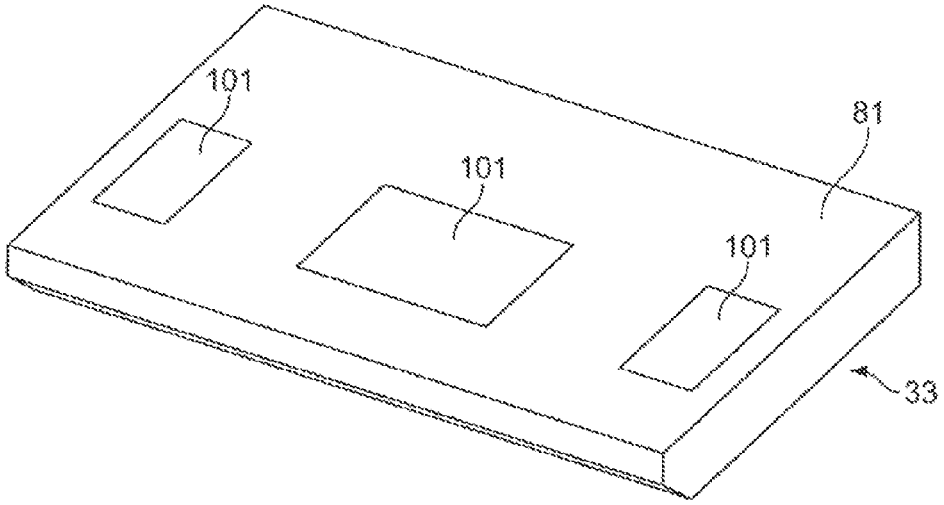
FIG. 5 shows a schematic perspective view of the bottom surface of a carrier unit according to the first embodiment.
Figure 6:
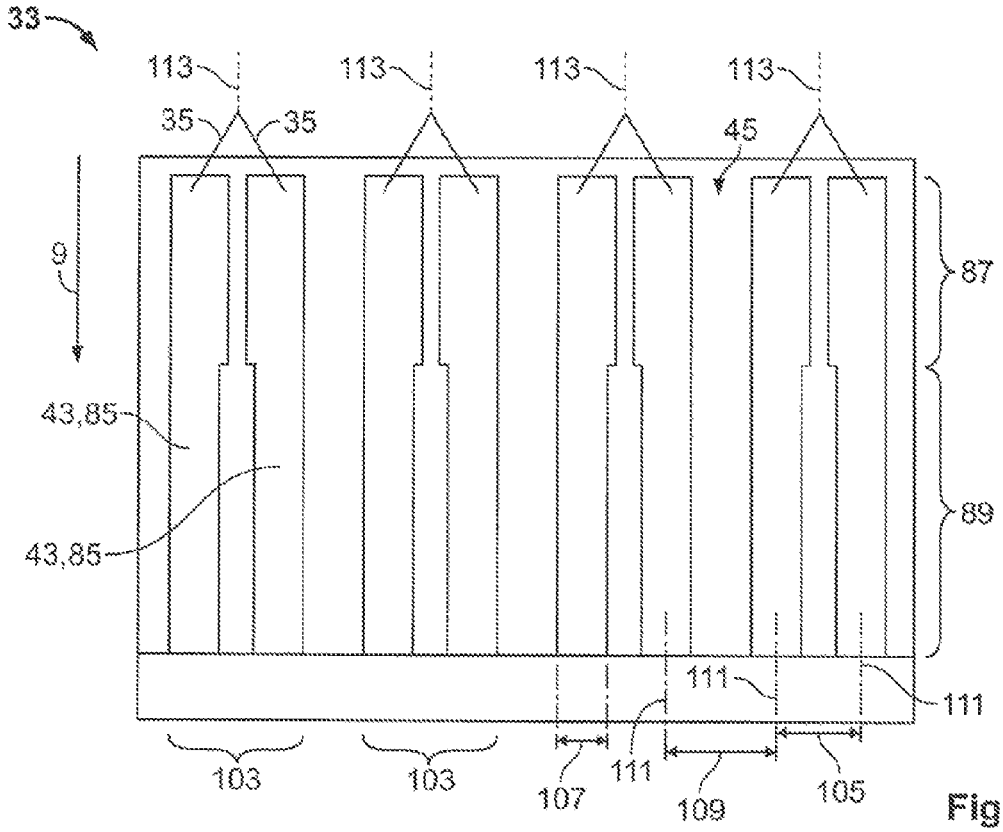
FIG. 6 shows a schematic drawing of contact strips on a carrier unit according to the first embodiment.

The data section 13 comprises a carrier unit 33, which is mounted on the data section side 31 of the separating wall assembly 29. The carrier unit 33 is arranged parallel to the power contact plane 21 and to the connecting direction 9. Data cables 35 are electrically connected to the carrier unit 33. The data cables 35 extend through the face opening 37 in the mounting side 39 of the mounting member 7. Data cable ends 41 of the data cables 35 are soldered onto data contacts 43, which are located on the data contact face 45 on the carrier unit 33. Each data cable 35 is electrically connected to one data contact 43. The carrier unit 33 is formed by a printed circuit board 83. The carrier unit 33 defines the data contact plane 46. The data contact plane 46 is parallel with the power contact plane 21. Details of the carrier unit 33 and the data contacts 43 are shown in FIGS. 4 to 6.

Above the data contact face 45 of the carrier unit 33, an open volume 47 extends in the connecting direction 9 and in a direction facing away from the data contact face 45. In the direction facing away from the data contact face 45, the open volume 47 is limited by a protective wall member 49. The protective wall member 49 extends parallel to the power contact and data contact planes 21, 46 and aligns with the connector face 5. The protective wall member 49 may comprise a supporting structure 51. Both the protective wall member 49 and the supporting structure 51 may be mounted on the mounting side 39 of the mounting member 7.

A width 52 of the power contacts 15 is measured parallel to power contact plane 21 and perpendicular to the connecting direction 9.

The connector face area, which is the product of the connector face height 48 and the connector face width 50 is preferably below 150 $mm^2$. Preferably the face width 50 is 16 mm or less. The face height 48 is preferably 12 mm or less, more preferably 10 mm or less. In one preferred embodiment the width 50 is 15.7 mm and the height 48 is 9.5 mm.

Figure 2:
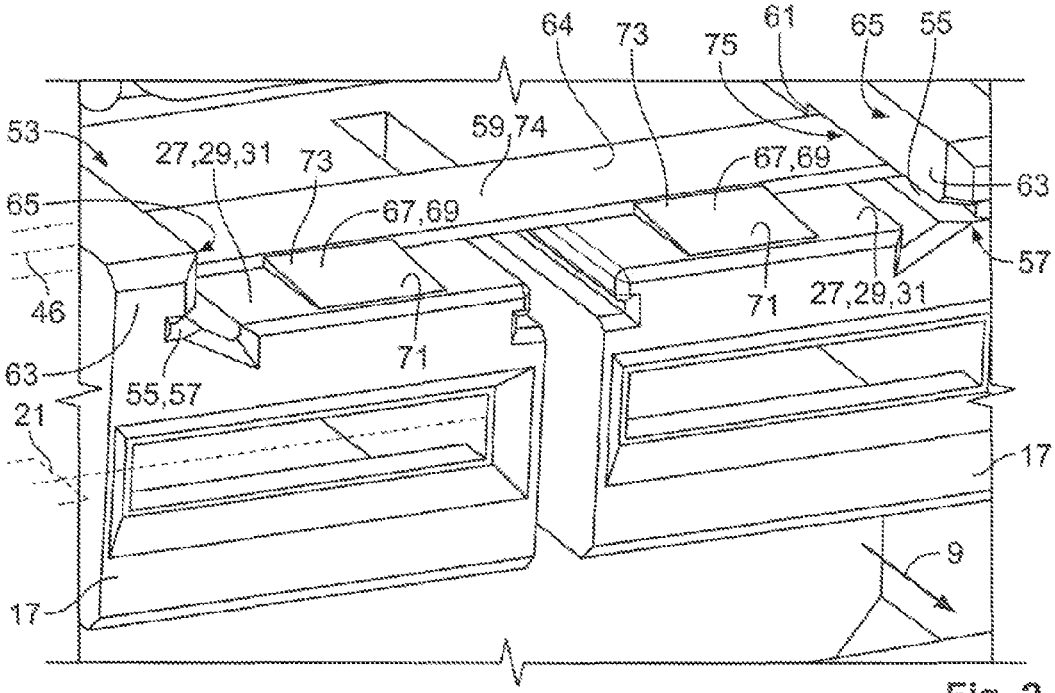
FIG. 2 shows a schematic perspective cut-out of a separating wall assembly and a fixation sub-assembly according to the first embodiment.

FIG. 2 shows a schematic perspective view of two shafts 17 and a fixation sub-assembly 53 with an inserted locking protrusion 59 according to the invention.

Each of the shafts 17 has a wall 27, which is part of the separating wall assembly 29. The fixation sub-assembly 53 comprises two fixation walls 63. The fixation walls 63 comprise alignment sides 65, which oppose each other. In the fixation walls 63, two grooves 55 are situated, which are aligned parallel to the connecting direction 9 and to the data contact plane 46. The two grooves 55 face each other. The two grooves 55 are situated at two opposite sides of the connector face 5.

The fixation walls 63 positively locks an inserted carrier unit 33 between the alignment sides 65 in the data contact plane 46 perpendicular to the connecting direction 9.

The grooves 55 comprise groove openings 57 which face into the connecting direction 9. The groove openings 57 and the grooves 55 are adapted to receive a locking protrusion 59 from a carrier unit 33. The grooves 55 are closed at closing positions 61, limiting an insertion depth for a locking protrusion 59. The grooves 55 are adapted to positively lock an inserted locking protrusion 59 in a direction away from the data contact plane 46.

The separating wall assembly 29 comprises two locking features 67. The locking features 67 are adapted to prevent an inserted locking protrusion 59 from being moved out of the fixation sub-assembly 53 in the connecting direction 9. The locking features 67 may be shaped as wedges 69. The flat side 71 of the wedges 69 may be aligned in the connecting direction 9, allowing a locking protrusion 59 to be easily inserted into the fixation sub-assembly 53. The thick side 73 of the wedges 69 may be aligned in a direction opposite to the connecting direction 9, positively locking an inserted locking protrusion 59.

The locking protrusion 59 may be formed as a separate strip 74. Short sides 75 of the separate strip 74 may be adapted to extend into the grooves 55 when the locking protrusion 59 is inserted in the fixation sub-assembly 53.

Figure 3:
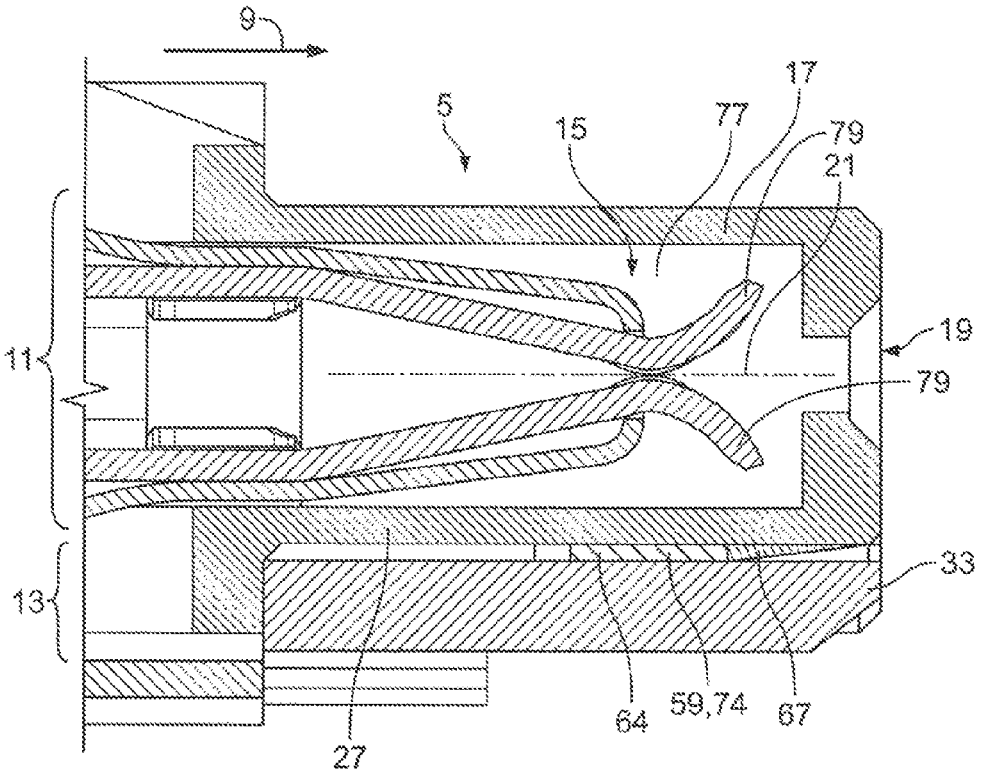
FIG. 3 shows a schematic side view of a connector face according to the first embodiment with a mounted carrier unit.

FIG. 3 shows a schematic sectional view of a data connector face 5 in a cut through one of the shafts 17 along a plane being perpendicular to the connecting direction 9 and to the power contact plane 21.

The shaft 17 comprises a cavity 77 in which a power contact 15 is located. The power contact 15 may comprise two power springs 79. The cavity 77 is accessible through the opening 19.

At the data section 13, a carrier unit 33 is mounted. The carrier unit 33 is mounted on a wall 27 of the shaft 17. The carrier unit comprises a locking sub-assembly 64. The locking sub-assembly 64 is identical with the locking protrusion 59 which is formed as a separate strip 74. The locking protrusion 59 is fixed onto a bottom surface 81 of the carrier unit 33. The carrier unit 33 is positively locked against movement in the connecting direction 9 by the locking feature 67.

FIG. 4 shows a schematic perspective view of a data contact face 45 of a carrier unit 33.

The carrier unit 33 is formed by a printed circuit board 83. The data contacts 43 are formed by elongated data contact strips 85. The data contact strips 85 extend parallel to the connecting direction 9.

Each data contact strip 85 comprises a soldering end 87 and a connecting end 89. Each soldering end 87 may comprise a soldering site 91 to which a data cable end 41 of a data cable 35 can be soldered. The connecting ends 89 are situated in the open volume 47 when the carrier unit 33 is mounted on a data section side 31 to be accessible for mating data contacts 123 of a socket assembly 115.

The printed circuit board 83 may comprise a soldering barrier 93, extending perpendicular to the connecting direction 9, separating the soldering ends 87 and the connecting ends 89 of the data contact strips 85. The soldering barrier 93 is located on top of the data contact strips 85 without interrupting the electrical connection between the soldering ends 87 and the connecting ends 89. The soldering barrier 93 may be adapted to prevent tin solder from reaching the connecting ends 89 during a process of soldering data cable ends 41 onto the soldering ends 87 of the data contact strips 85.

The printed circuit board 83 may comprise an insertion edge 95. The insertion edge 95 may be chamfered. The width 97 of the chamfered insertion edge 95 may be equivalent to a thickness 99 of the printed circuit board 83.

FIG. 5 shows the bottom surface 81 of a carrier unit 33.

The bottom surface 81 of the carrier unit 33 may comprise soldering pads 101. The soldering pads 101 may be soldered onto a locking protrusion 59. The bottom surface 81 may comprise three soldering pads 101. The soldering pads 101 may be tin-plated. A locking protrusion may be made from a metallic material so that the soldering pads 101 can be easily soldered onto the locking protrusion 59.

According to an advantageous improvement, a locking protrusion 59 can be fixated at the bottom surface 81 of the carrier unit 33, being aligned with the soldering pads 101 and can be subsequently heated in order to form a solder connection between the bottom surface 81 and the locking protrusion 59.

FIG. 6 shows a schematic top view on the data contact face 45 of a carrier unit 33 according to the first embodiment.

The data contacts 43 are arranged in parallel pairs 103. The data contacts 43 may be formed by data contact strips 85. The distance 105 between two data contacts 43 of a pair 103 of data contacts 43 is preferably chosen to be between 1.4 and 1.6 times the width 107 of a data contact 43 at its connecting end 89.

The distance 109 between two adjacent data contacts 43 of adjacent pairs 103 is preferably chosen to be between 2.1 and 2.3 times the width 107 of a data contact 43 at its connecting end 89.

The distances 105 and 109 are measured as distances between centre lines 111 of the data contacts 43 at their connecting ends 89. At their soldering end 87, the data contacts 43 may be formed wider than at the connecting ends 89 in order to simplify a soldering process.

The carrier unit 33 may comprise four pairs 103 of data contacts 43. The data contacts 43 may be connected to an Ethernet cable carrying four twisted pairs 113 of data cables 35. Each twisted cable pair 113 may preferably be connected to one pair 103 of data contacts 43. The pair-wise connection between twisted cable pairs 113 of an Ethernet cable and pairs 103 of data contacts 43 differs from the well-known T568A standard for Ethernet connectors. However, the pair-wise connection may provide an improved signal integrity, especially at high data rates.

The width 107 of the data contacts is smaller than the width 52 of the power contacts 15. The width 52 of the power contacts 15 may be a multiple of the width 107 of the data contacts 43.

Figure 7:
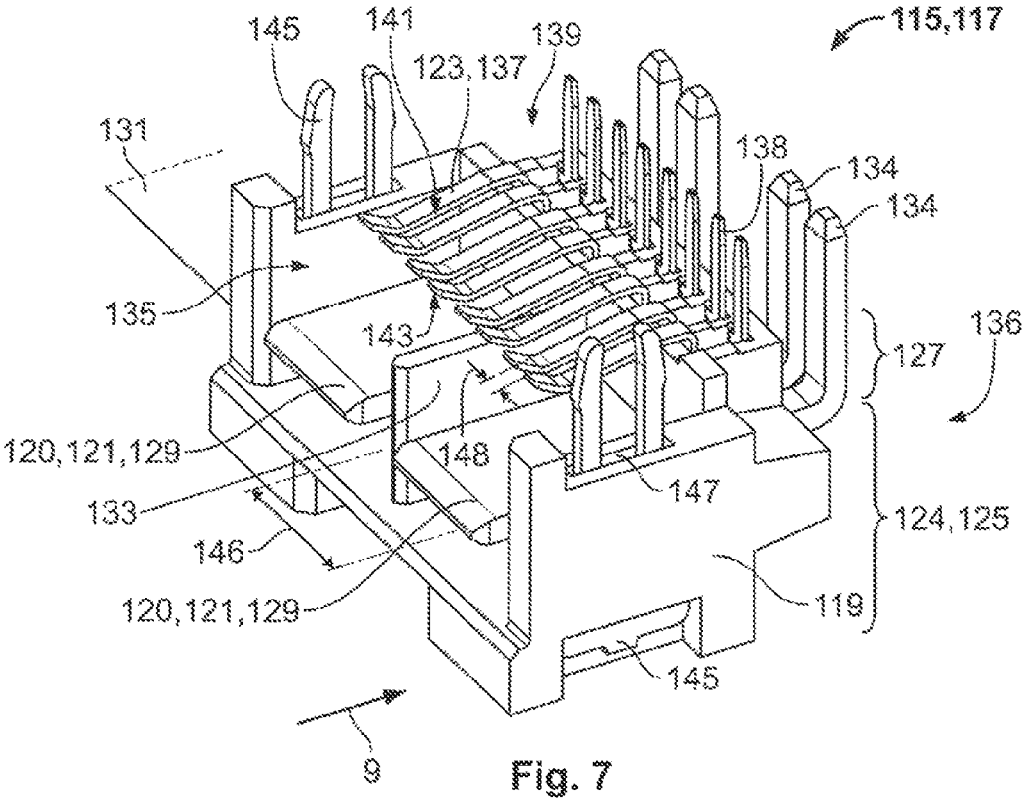
FIG. 7 shows a schematic perspective view of a socket assembly according to a first embodiment in a bottom-up view.

FIG. 7 shows a schematic perspective view of a socket assembly 115 according to the invention.

The socket assembly 115 is assembled to a combined power and data socket 117. The socket assembly 115 comprises a data section 127 and a second section 124, which is a power section 125. The socket assembly 115 comprises a socket housing 119. The socket housing 119 is adapted to carry the contact elements 120, which are power contacts 121 and the data contacts 123.

The power section 125 comprises two power contacts 121. The power contacts 121 are formed as blade contacts 129. The blade contacts 129 are aligned parallel to each other, both blades 129 defining a common blade contact plane 131. The power contacts 123 extend in a direction opposite to the connecting direction 9.

The power section 125 may comprise a separating structure 133, which extends between the two power contacts 121 perpendicular to the blade contact plane 131. The separating structure 133 may be adapted to fit into a separating space 25 of a mating connector assembly 1, thus providing a guidance during insertions of a connector. The power contacts 121 comprise power contact connectors 134. The power contact connectors 134 extend through a back side 136 of the socket housing 119.

The data section 127 comprises a plurality of data contacts 123. The data section 127 may comprise preferably eight data contacts 123. The data contacts 123 may be arranged in an array parallel to the blade contact plane 131. The data contacts 123 and the power contacts 121 are situated in a shared open volume 135.

The data contacts 123 may preferably be formed as spring contacts 137. The spring contacts 137 may comprise a mounting section 139 and a spring section 141. Each section 141 may comprise a spring face 143. The spring face 143 may preferably be adapted to establish an electric contact to a data contact 43 of a mating connector assembly 1. The spring faces 143 are facing the power contacts 121. The data contacts 123 are preferably arranged pair-wise in order to be connected to pairs 103 of mating data contacts of a connector 3. Each mounting section 139 of a data contact 123 may comprise a data contact connector 138.

The socket assembly 115 may comprise at least one fixing member 145. The fixing member 145 may be inserted through a fixing channel 147 in the socket housing 119 in order to fix the socket housing 119 onto a structure, such as a printed circuit board or a device housing.

The width 146 of a blade contact 129 is a multiple of a width 148 of a data contact 123.

Figure 8:
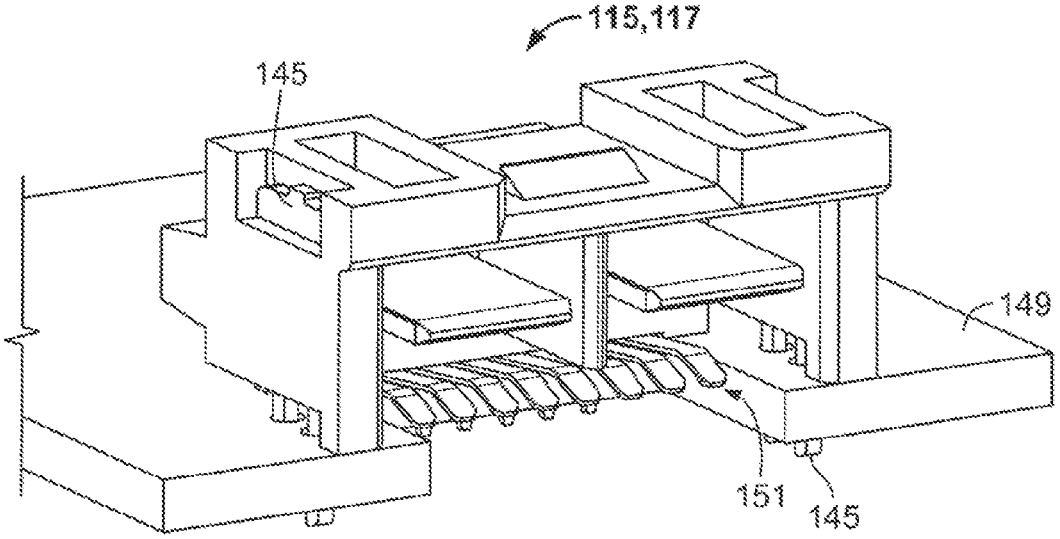
FIG. 8 shows a schematic perspective view of a socket assembly according to the first embodiment in a mounted state.

FIG. 8 shows a schematic perspective view of an assembled socket assembly 115 in a mounted state.

The socket 117 is mounted on a mounting structure 149. The mounting structure 149 may preferably be formed by a printed circuit board. The socket 117 is mounted on the mounting structure by the fixing members 145, which extend through the fixing channels 147 into the mounting structure 149. The power contact connectors 134 and the data contact connectors 138 may preferably be led through the mounting structure 149 to be accessible for being electrically connected.

The mounting structure 149 may preferably comprise a receiving recess 151 in which a carrier unit 33 of an inserted mating connector 3 may be received.

Figure 9:
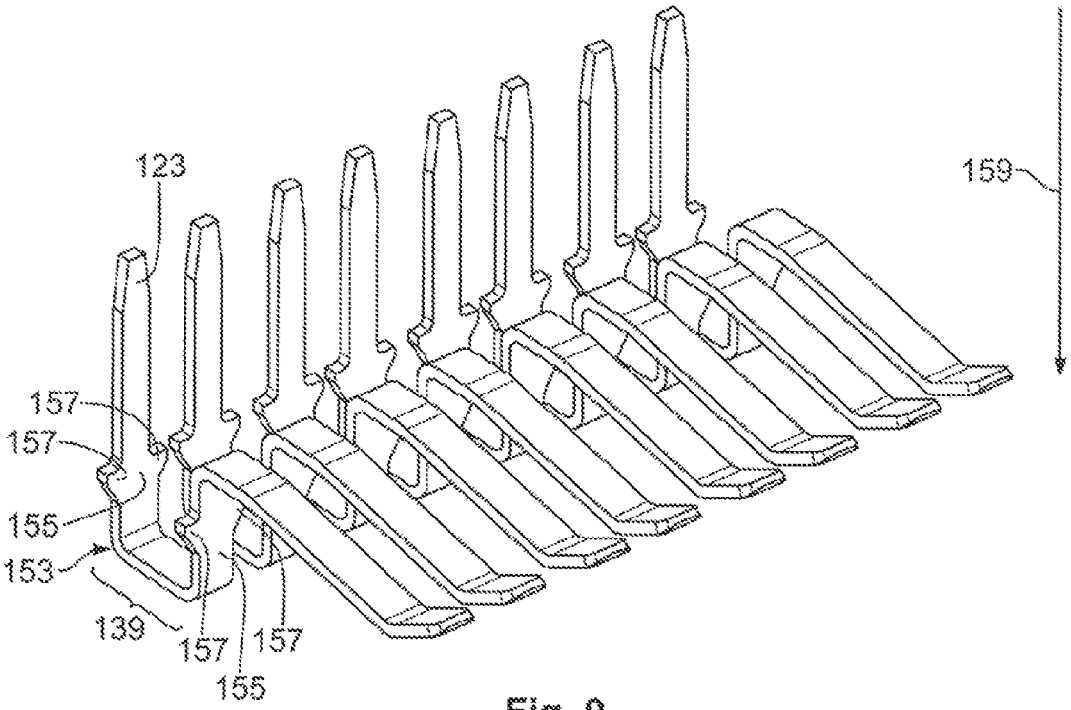
FIG. 9 shows a schematic perspective view of an array of data contacts of a housing according to the first embodiment of a socket assembly.

FIG. 9 shows a schematic perspective view of an array of data contacts 123 of a socket assembly 115 according to the invention.

The data contacts 123 comprise U-shaped fixation members 153 in their mounting sections 139. Each fixation member 153 comprises two parallel sections 155. The parallel sections are spaced apart from each other. Each parallel section 155 comprises two fixation wings 157. The fixation wings 157 are tapered along an insertion direction 159 of the fixation members 153. The two fixation wings 157 extend from opposite sides of each parallel section 155.

Figure 10:
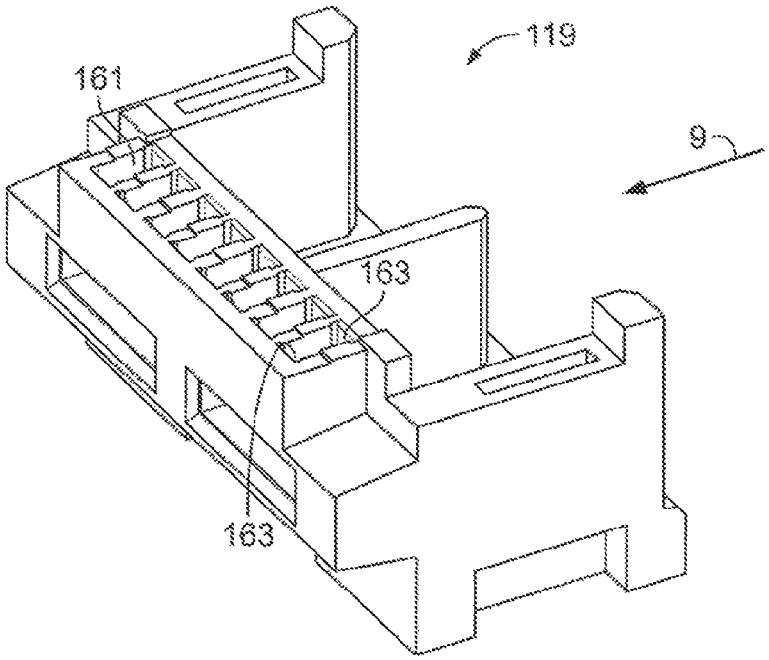
FIG. 10 shows a schematic perspective view of a socket housing according to the first embodiment.

FIG. 10 shows a schematic perspective view of a socket housing 119 of a socket assembly 115 according to the invention.

The socket housing 119 comprises a plurality of pockets 161 being aligned in an array perpendicular to a connecting direction 9. The pockets 161 are arranged adjacent to the shared open volume 135, having an elongated shape which is aligned parallel to the connecting direction 9. The pockets 161 are adapted to receive the U-shaped fixation members 153 of the data contacts 123. Each pocket 161 may comprise two guiding slits 163, adapted to receive and guide the fixation wings 157 of the fixation springs 153.

Figure 11:
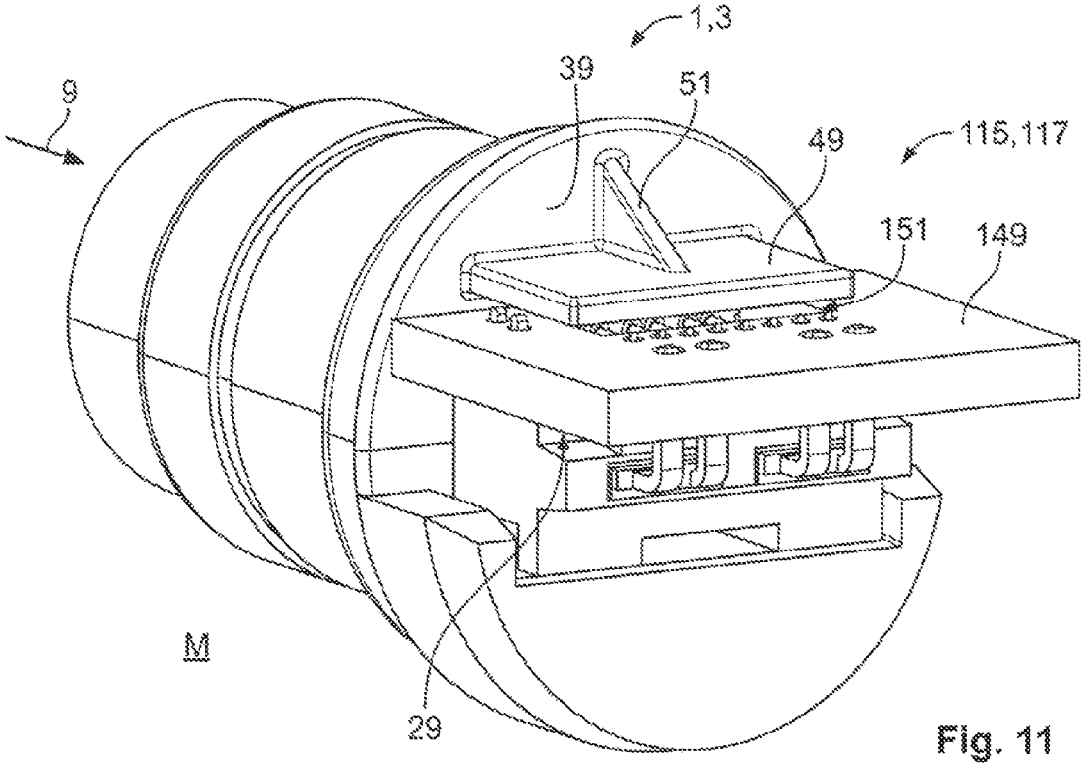
FIG. 11 shows a contact assembly according to the first embodiment in a mated state with a mating socket assembly according to the first embodiment of a socket assembly.
Figure 12:
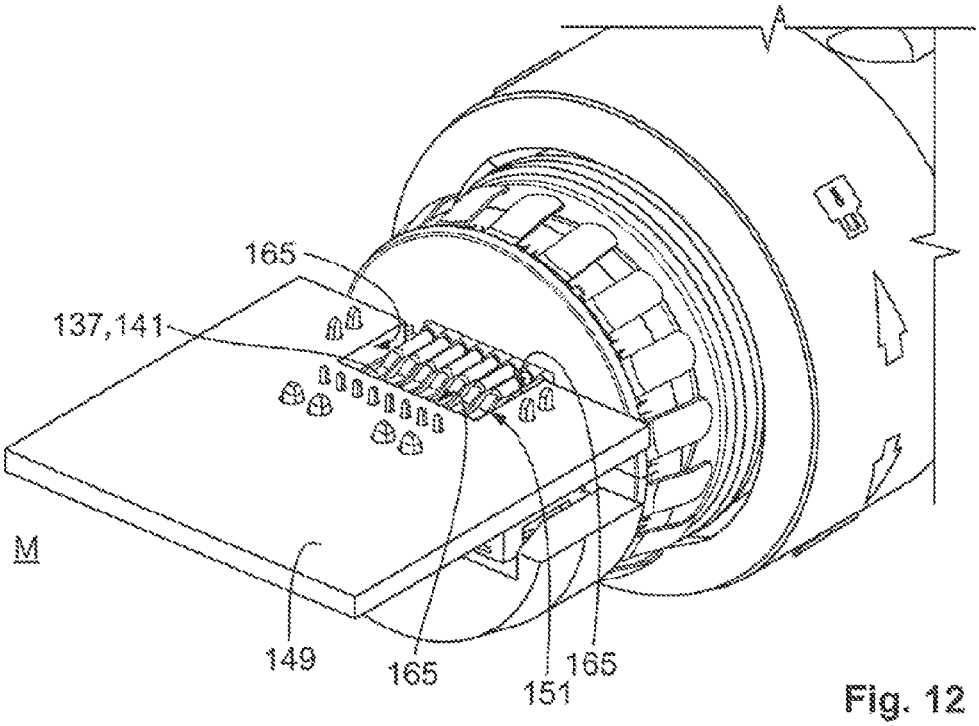
FIG. 12 shows a contact assembly and a socket assembly in a mated state as shown in FIG. 11 in a cut view.

FIGS. 11 and 12 show a contact assembly 1 according to the first embodiment assembled to a connector 3 being in a mated state M in which the connector 3 is mated with a socket 117 which is formed by socket assembly 115 according to the first embodiment for a socket assembly. FIG. 12 shows a cut view in which the protective wall member 49 and the supporting structure 51 are not shown. In the mated state M, the connector face 5 protrudes into the shared open volume 135 of the socket 117. The power contacts 121 of the socket 117 are inserted into the shafts 17 and mate with the power contacts 15. The data contacts 123 from the socket 117 contact the data contacts 43 of the carrier unit 33.

The spring sections 141 of the data contacts 123 which are formed by spring contacts 137 are elastically deflected into a direction away from the carrier unit 33. The receiving recess 151 of the mounting structure 149 forms a volume for the spring sections 141 which allows the spring sections 141 to move away from the carrier unit 33 when the connector face 5 protrudes into the socket 117.

In the mated state M, the data contacts 43 of the contact assembly 1 and the data contacts 123 of the socket 117 are situated between the separating wall assembly 29 and the protective wall member 49 in a direction perpendicular to the carrier unit 33. In the connecting direction 9 and also perpendicular to the connecting direction 9 in the data contact plane 46, the data contacts 43 and the data contacts 123 are confined between inner walls 165 of the mounting structure 149. The arrangement of the data contacts 43 and the data contacts 123 between the afore-mentioned elements may protect the data contacts 43 and the data contacts 123 against hazards.

Figure 13:
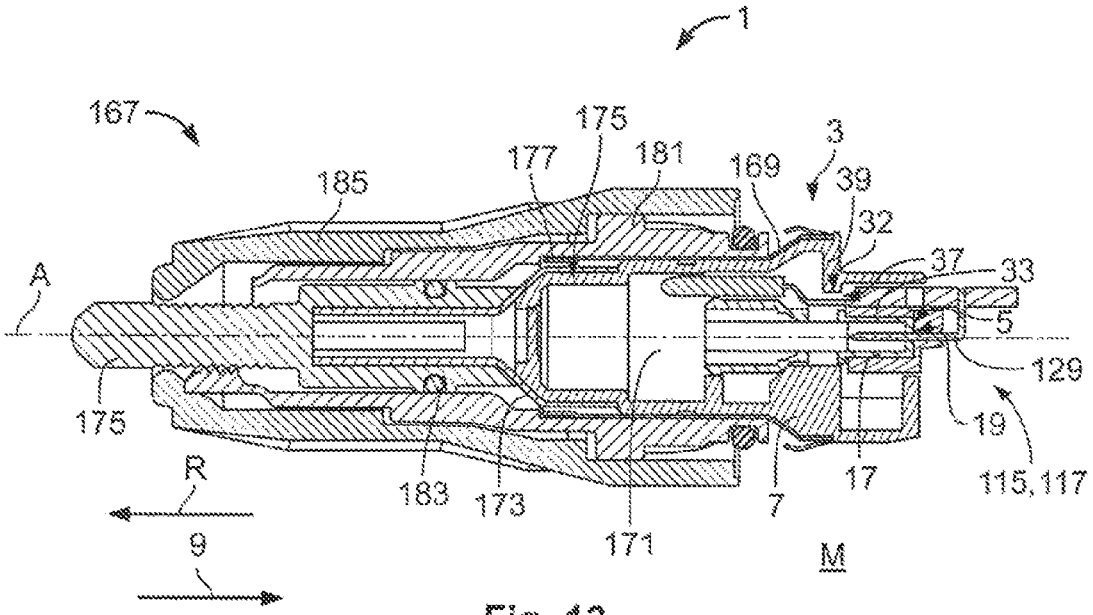
FIG. 13 shows a cut view of a contact assembly and a socket assembly in a mated state according to the previous described embodiment wherein the contact assembly further comprises an enclosure assembly.

FIG. 13 shows a cut along the centre plane parallel to a connection axis A of an assembled contact assembly 1 according to the first embodiment as described above but comprising additionally an encloser assembly 167. The connector axis A is parallel with the connecting direction 9 and a rearward direction R. The rearward direction R is defined as being opposite to the connecting direction 9.

The contact assembly 1 is shown in a mated state M in which it is mated with the socket assembly 115. The blade contacts 129 protrude into the shafts 17 through the opening 19. In the shafts 17, power contacts 15 can be situated to establish an electrical contact with the blade contacts 129. In an alternative embodiment, the shafts 17 can be empty so that the protrusion of the blade contact 129 into the shafts 17 increases the stability of the mating elements.

The connector face 5 protrudes through the face opening 37 from the mounting member 7 into the connecting direction 9. Between the connector face 5 and the mounting member 7, the floating space 32 allows a movement of the connector face 5 at least perpendicular to the connecting direction 9.

The mounting member 7 is surrounded by an electric shielding structure 169. The electric shielding structure extends basically in a circumferential direction around the connector axis A and protects the inner volume 171 of the mounting member 7 and the elements therein against electromagnetic fields. A shielding ferrule 173 surrounds a rearward end 175 of the mounting member 7 and extends into the rearward direction R opposite to the connecting direction 9. The shielding ferrule 173 is fixated onto the rearward end 175 of the mounting member 7. The shielding ferrule 173 is electrically connected to the electric shielding structure 169 via a contact spring 177, which surrounds the shielding ferrule 173.

The shielding ferrule is at least partially surrounded by a strain relief 179 which extends from the shielding ferrule 173 into the rearward direction R. The strain relief 179 may also seal at least the shielding ferrule 173 against dust and water. The strain relief 179 may be adapted to seal at least the shielding ferrule 173 according to the standard IP-65.

An inner body 181 surrounds the strain relief 179 and the mounting member 7 at least partially in a circumferential direction around the connector axis A. Between the inner body 181 and the strain relief 179, a sealing ring 183 is located.

Around the inner body 181, an outer body 185 is located, which surrounds the inner body 181 in a circumferential direction around the connector axis A at least in part. The outer body 185 may be adapted to be mated with a mating enclosure which may be a part of the socket assembly 115. The outer body 185 may be moveable relatively to the inner body 181. Further, the mounting member 7 and the shielding ferrule 173 may be moveable relative to the inner body 181 and the electric shielding structure 169 at least in a direction parallel to the connector axis A.

Figure 14:
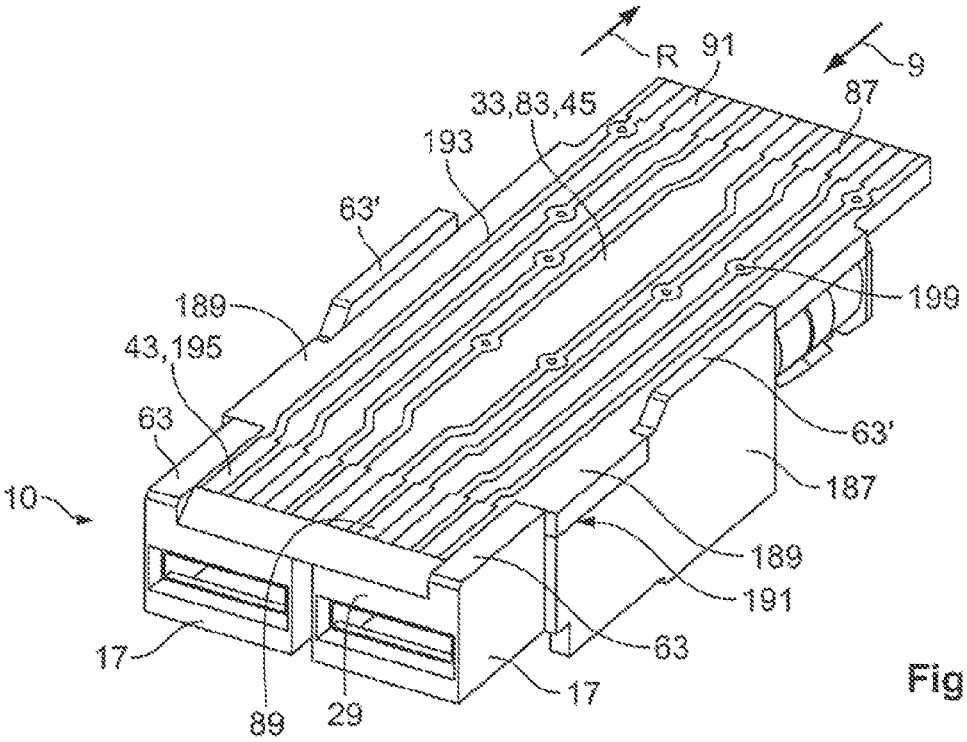
FIG. 14 shows a second embodiment of a contact assembly according to the invention.
Figure 15:
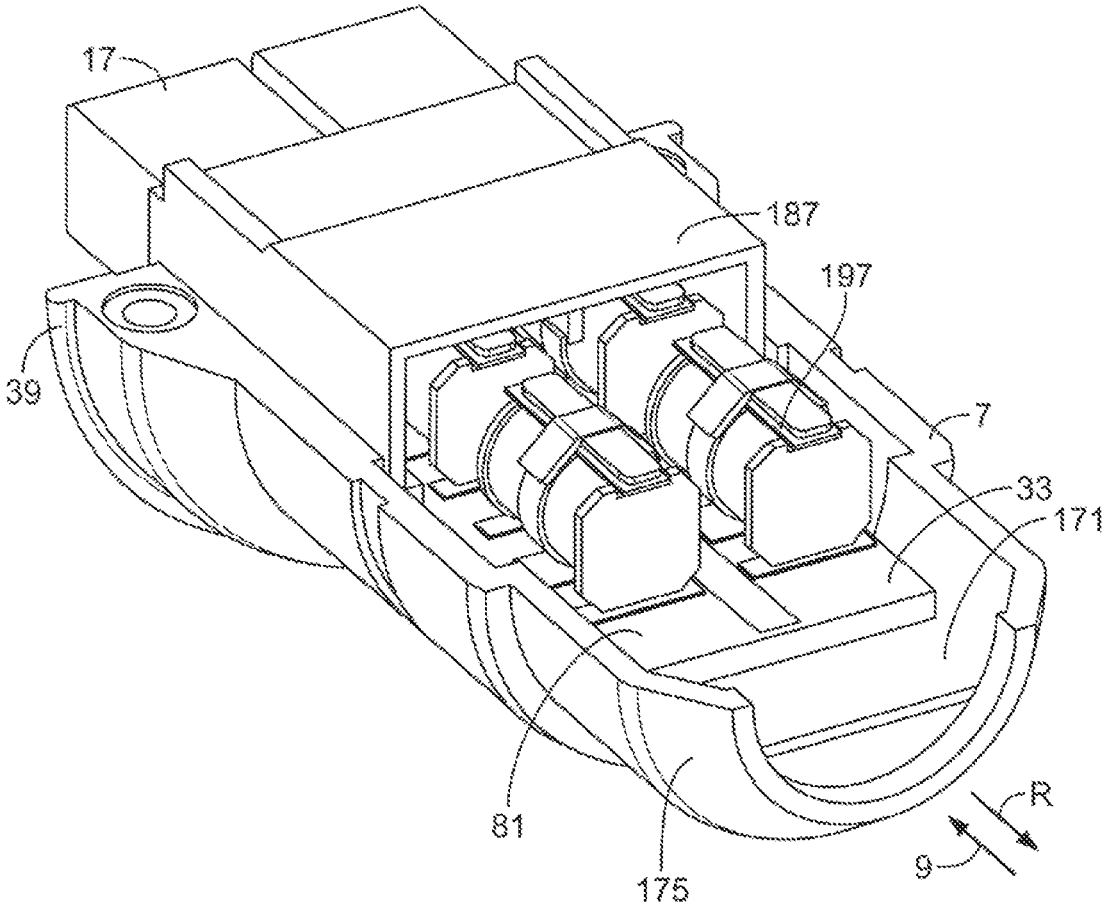
FIG. 15 shows a contact assembly according to the second embodiment with a mounting member in a cut view.

FIGS. 14 and 15 show a second embodiment of a contact assembly according to the invention. For the sake of clarity, only the differences to the afore-mentioned embodiment are described. The carrier unit 33 extends along the rearward direction R into the inner volume 171 of the mounting member 7. In the second section 10, the connector face 5 comprises an arrester housing 187 which extends from the shafts 17 into the rearward direction R. In addition to the fixation walls 63 which are situated on the shafts 17, the connector face 5 comprises two additional fixation walls 63' which protrude from the arrester housing 187. The carrier unit 33 comprises two mounting prominences 189 which extend into mounting openings 191 which are located between the fixation walls 63 and 63'.

The carrier unit 33, which is formed as a printed circuit board 83 comprises soldering sites 91, which are situated inside the open volume 171 when the contact assembly 1 comprises a mounting member 7. The soldering sites 91 are arranged at the soldering end 87 which is opposite to the connecting end 89. Between the connecting end 89 and the soldering end 87 of the data contacts 43, conductive lines 193 connect soldering sites 91 with connecting portions 195 of the data contacts 43. The conductive lines 193 extend basically parallel to the connecting direction 9.

On the bottom surface 81 of the carrier unit 33, a surge arrester 197 is located. The surge arrester extends at least partially into the arrester housing 187. The surge arrester 197 is electrically connected with the conductive lines 193 by connecting means (not shown) which extend through connecting openings 199 in the carrier unit 33. The connecting openings 199 are encircled by the conductive lines 193 on the data contact face 45 of the carrier unit 33.

The invention claimed is:

1. A contact assembly for a combined power and data connector, comprising a connector face, facing in a connecting direction, the connector face comprising a first section and a second section, wherein the first section is a data section and comprises a plurality of data contacts, which are separated from the second section by at least one separating wall assembly, the data contacts being arranged on a carrier unit, that is mounted on a data section side of the separating wall assembly, the data section side of the separating wall assembly being opposite the second section of the connector face, wherein the carrier unit further carries electric power and wherein the at least one separating wall assembly comprises a fixation sub-assembly that fixates the carrier unit onto the separating wall assembly, and wherein the connector face is mounted in a mounting member, the mounting member allowing a relative movement between the separating wall assembly together with the fixated carrier unit and the mounting member at least perpendicular to the connecting direction.

2. The contact assembly according to claim 1, wherein the fixation sub-assembly comprises at least one fixation wall that fixates the carrier unit.

3. The contact assembly according to claim 1, wherein the connector face comprises an open volume above the data contacts on the data section side of the carrier unit, the open volume receding from the connector face against the connecting direction.

4. The contact assembly according to claim 1, wherein said fixation sub-assembly positively locks the carrier unit onto the separating wall assembly.

5. The contact assembly according to claim 4, wherein the fixation sub-assembly comprises at least one groove which opens into the connector face and which extends parallel to the connecting direction, the carrier unit comprising at least one locking sub-assembly which is configured to be inserted into the at least one groove against the connecting direction.

6. The contact assembly according to claim 5, wherein the locking sub-assembly of the carrier unit is provided with at least one locking protrusion, which protrudes from a bottom surface of the carrier unit, the bottom surface facing the second section, the locking protrusion being configured to be engaged to a locking feature on the separating wall assembly.

7. The contact assembly according to claim 6, wherein the locking protrusion extends perpendicular to the connecting direction into the at least one groove.

8. The contact assembly according to claim 1, wherein the second section comprises at least one protruding shaft, adapted to receive at least one additional connector element, one wall of the shaft being part of the separating wall assembly.

9. The contact assembly according to claim 1, wherein the connector face protrudes through a face opening in a mounting side of a mounting member, the face opening being laterally greater than the connector face and comprising a floating space which laterally surrounds the connector face.

10. The contact assembly according to claim 1, wherein the second section is a power section which comprises at least one, preferably two, power contact(s).

11. The contact assembly according to claim 1, wherein the carrier unit is formed by a printed circuit board, the printed circuit board carrying data contacts which are formed as data contact strips.

12. The contact assembly according to claim 11, wherein the data contacts are arranged in parallel pairs and wherein a plurality of twisted cable pairs is connected to the carrier unit, each twisted cable pair being electrically connected to a pair of adjacent data contacts.

13. A socket assembly for a combined power and data socket, comprising a socket housing, a connector face comprising a data section and a second section, wherein the second section comprises at least two contact elements and wherein the data section comprises a plurality of data contacts, the contact elements and the data contacts being situated in a shared open volume, and wherein the connector face protrudes through a face opening in a mounting side of a mounting member, the face opening being laterally greater than the connector face and comprising a floating space which laterally surrounds the connector face.

14. The socket assembly according to claim 13, wherein the at least two contact elements are formed by blade contacts, a common plane of the blade contacts being aligned in parallel to an array of data contacts.

15. The socket assembly according to claim 13, wherein the socket housing comprises a plurality of pockets, and wherein the plurality of data contacts comprises U-shaped fixation members, the fixation members being inserted into the pockets.

16. A contact assembly for a combined power and data connector, comprising a connector face, facing in a connecting direction, the connector face comprising a first section and a second section, wherein the first section is a data section and comprises a plurality of data contacts, which are separated from the second section by at least one separating wall assembly, the data contacts being arranged on a carrier unit, that is mounted on a data section side of the separating wall assembly, the data section side of the separating wall assembly being opposite the second section of the connector face, wherein the carrier unit further carries electric power and wherein the at least one separating wall assembly comprises a fixation sub-assembly that fixates the carrier unit onto the separating wall assembly, and wherein the second section comprises at least one protruding shaft, adapted to receive at least one additional connector element, one wall of the shaft being part of the separating wall assembly.

17. A contact assembly for a combined power and data connector, comprising a connector face, facing in a connecting direction, the connector face comprising a first section and a second section, wherein the first section is a data section and comprises a plurality of data contacts, which are separated from the second section by at least one separating wall assembly, the data contacts being arranged on a carrier unit, that is mounted on a data section side of the separating wall assembly, the data section side of the separating wall assembly being opposite the second section of the connector face, wherein the carrier unit further carries electric power and wherein the at least one separating wall assembly comprises a fixation sub-assembly that fixates the carrier unit onto the separating wall assembly, and wherein the carrier unit is formed by a printed circuit board, the printed circuit board carrying data contacts which are formed as data contact strips.

18. The contact assembly according to claim 17, wherein the data contacts are arranged in parallel pairs and wherein a plurality of twisted cable pairs is connected to the carrier unit, each twisted cable pair being electrically connected to a pair of adjacent data contacts.

* * * * *